US006793362B2

(12) United States Patent
Tai

(10) Patent No.: US 6,793,362 B2
(45) Date of Patent: Sep. 21, 2004

(54) FLASHER LIQUID CONTAINER VESSEL

(76) Inventor: Ti Hsien Tai, 804 Boston Ave., Montebello, CA (US) 90640

( * ) Notice: Subject to any disclaimer, the term of this patent is extended or adjusted under 35 U.S.C. 154(b) by 0 days.

(21) Appl. No.: 10/278,592

(22) Filed: Oct. 23, 2002

(65) Prior Publication Data

US 2003/0081408 A1 May 1, 2003

Related U.S. Application Data

(60) Provisional application No. 60/350,101, filed on Oct. 26, 2001.

(51) Int. Cl.[7] ..... F21W 131/30

(52) U.S. Cl. ..... 362/101; 362/96; 362/253; 362/802

(58) Field of Search ..... 362/802, 101, 362/96, 253, 806

(56) References Cited

U.S. PATENT DOCUMENTS

| | | | | |
|---|---|---|---|---|
| 4,922,355 A | | 5/1990 | Dietz et al. | 362/101 |
| 5,143,439 A | | 9/1992 | Lewis et al. | 362/103 |
| 5,211,699 A | | 5/1993 | Tipton | 362/101 |
| 5,575,553 A | | 11/1996 | Tipton | 362/101 |
| 5,785,407 A | * | 7/1998 | Ratcliffe et al. | 362/101 |
| 6,005,204 A | * | 12/1999 | Choi et al. | 200/52 R |
| 6,163,248 A | * | 12/2000 | Paek et al. | 340/321 |
| 6,164,793 A | * | 12/2000 | Wu | 362/101 |
| 6,419,384 B1 | * | 7/2002 | Lewis et al. | 362/562 |
| 6,511,197 B1 | * | 1/2003 | Kalemjian | 362/101 |

* cited by examiner

*Primary Examiner*—Laura K. Tso
(74) *Attorney, Agent, or Firm*—Robert W. Mulcahy

(57) ABSTRACT

A novelty translucent liquid container provides a separately compartmented electronic assembly with a multiplicity of bulbs for flashing distribution of light throughout the container. The production and distribution of flashing light throughout a liquid in the container generates a pleasant and dynamic luminescent effect rendering the container useful, as a promotional item or novelty item for a business establishment, business, product, or service. The container includes a vessel having translucent circumferential or polygonal side walls and a separate segregated compartment preferably formed at the base of the container for housing the flashing electronic device. A circuit board with a multiple light bulb flashing capability in the form of LEDs operates within the separate compartment to effect blinking lights through the vessel causing a dynamic luminescent effect throughout the liquid container. When the vessel contains a liquid, an amplified blinking light arrangement ensues giving a magnified impression of the liquid through the translucent or transparent walls of the vessel. Additionally, the electronic assembly in the container may contain a preprogrammed microchip and a speaker to provide audio corresponding to selected sounds such as music.

6 Claims, 5 Drawing Sheets

FLASHER LIQUID CONTAINER VESSEL

This application claims benefit of U.S. Provisional Application No. 60/350,101, filed Oct. 26, 2001, which is hereby incorporated by reference in its entirety.

BACKGROUND OF THE INVENTION a) Field of the Invention

The present invention relates to a novelty item in the form of a translucent container for holding liquids having a flashing light assembly therein and, more particularly, liquid containers having low amperage light and sound producing and distributing electronic assemblies to provide a dynamic array of emitted blinking lights throughout the translucent container. The flashing light effect can be optionally accompanied by sounds such as music rendering these containers useful as promotional or novelty items for a business, business establishment, product, or service as well as for personal enjoyment.

b) Description of the Related Art

In the world of advertising and promotion, objects bearing a particular trademark, trade name, design, or logo are often manufactured for heightening customer awareness of the business, establishment, product, or service to which the name, design, or logo relates. Therefore, in bars, restaurants and casinos, for example, matchbooks, coasters, glassware, plasticware, and the like, are found bearing some form of identification to heighten customer awareness of the establishment. Unfortunately, such identifying material is most often presented in a straightforward manner such as printing on the exterior of a drinking glass or container such that it soon becomes commonplace to the user/customer and, as a result, is unnoticed and is largely ineffective as a promotional item for that which the vessel is intended to promote and advertise.

Lighted liquid vessels, particularly in the form of drinking containers, are well known in the art. For example U.S. Pat. Nos. 5,575,553, 5,211,699, 4,922,355, and 4,563,726, all herein incorporated by reference in their entirety, all teach illuminated beverage drinking containers having a light source in the form of a bulb or light emitting diode (LED) at the base of the container. Some of the challenges presented with these prior art lighted drinking containers are the heat generated by the use of filamentous light bulbs and the costs of the LED devices. These problems would not be particularly significant if a single or a few bulbs or light sources were used; however, the instant invention contemplates the use of a liquid container having an array of lights. A multiplicity of light bulbs would produce an excessive and undesirable amount of heat for the captured liquid and a multiplicity of LED devices would be prohibitively expensive. The instant invention is directed to the use of an array of light emitting sources in a liquid container in a serially blinking arrangement to create a novel flashing liquid vessel. The continuous flashing in th vessel renders a customer/user persistently aware of the vessel itself as well as messages or other printed matter on the vessel, and, further, the amount of liquid in the vessel container.

Electronic blinking novelty items have been available for a number of years to suit many applications such as decorations, advertising signs and other attention-getting devices. Such electronic blinking novelty items have used both digital and analog oscillating circuitry. However, such prior novelty items have been made with little regard for the duty cycle of battery or power sources and seemingly little desire to conserve battery life. The oscillating circuitry of most prior novelty items have been inefficient and have required large batteries to obtain long lives. Among the prior patents disclosing such prior oscillating circuits are U.S. Pat. Nos. 3,805,047; 3,866,035; 3,918,184; 4,076,978; 2,815,388; 4,459,645; 4,556,932; 4,634,148; and 4,719,544 all hereby incorporated by reference in their entirety. Use of a LED flashing or blinking capability in a novelty item is demonstrated in U.S. Pat. No. 5,903,212, herein incorporated by reference in its entirety, where a novel blinking ice cube device is shown.

It would therefore be desirable to have an attention-getting liquid container item, wherein the user/customer is not only provided with desired printed and volume content information, but the item also actively engages the customer/user in a manner that entertains as it heightens awareness.

SUMMARY OF THE INVENTION

The present invention is directed to a flashing container for holding liquid that can be used as a promotional item for a business,business establishment, product, or service as well as for personal domestic use. This invention provides a novelty liquid container flashing assembly that may be adapted to provide an infinity of liquid container vessels with a variety of indicia on the surface of the vessel and an unlimited location area of a blinking light assembly housed on or in the vessel. The invention employs an electronic module containing a LED with an array of blinking lights which flash continuously upon switch activation. In one embodiment, the invention overcomes the problems of prior blinking light novelty items through employment of an electronic circuit adapted to drive a light emitting diode with a current pulse of very short duration to permit the use of a small battery and to provide a battery life unparalled by prior devices. In this liquid container invention, a capacitor is used in a high efficiency oscillator circuit only in the determination of blinking rate and battery current duty cycle, allowing the use of a wide variety of smaller value capacitors that lend themselves to microelectronic packaging desirable in flasher assemblies to be used in the liquid vessels herein.

In addition, the invention demonstrates a blinking light or flasher assembly housed in a separate segregated liquid impervious compartment of the liquid containing vessel and fastened therein by any means known in the art. The flashing electronic assembly is also outfitted with a conductive pin, lever, or strip communicating with the outside of the vessel to serve as an electrical switch to turn the flashing assembly on and off. In another embodiment of the vessel, the electronic module is a printed circuit having at least one speaker and a preprogrammed microchip to provide audio generating signals to produce sounds such as music.

In accordance with one embodiment of the present invention, a container for holding liquid comprises a vessel adapted to contain liquid therein, the vessel including a base, a translucent circumferential side wall or polygonal flat surfaced walls connected to the base, and a separate impervious compartment in the base housing a blinking light assembly whereby when the blinking light assembly is activated an alternating flashing of lights occurs throughout the vessel to amplify both the captured liquid and the side walls of the vessel.

Novelty flashing liquid containing assemblies of this invention therefore include a translucent circumferential container portion adapted to bear an indicia on its face and a segmented impervious compartment attached to the circumferential container portion to provide an opening to receive and house a light emitting diode at any location on or in the container, preferably below the base of the container. In one embodiment, the electronic assembly comprises a printed circuit board bearing an electronic flasher circuit and including a light emitting diode connected to the electronic flasher circuit on the printed circuit board. Because of its short duty cycle, the electronic flasher circuit includes a small battery to power the electronic flasher circuit and the light emitting diode, which battery is connected to the circuit by a flexible conductive strip, pin, or metal strip extending from the circuit board over to the area of the battery. The printed circuit board can be fitted within a pre-sized separate compartment or carries a pin, lever, hook or other fastening portion to secure the LED electronic module to the impervious compartment located at the base of the vessel. In accordance with another embodiment of the present invention, the vessel further includes a second LED electronic module housed in a second impervious compartment at second location in the circumferential wall of the vessel.

The preferred electronic flashing circuit of the invention comprises a switching transistor serially connected with a small current limiting resistance between the battery and the light emitting diode. The switching transistor is controlled by a transistor control network, including a control transistor, which is serially connected between the base-to-emitter junction of the switching transistor and the battery, and a resistor-capacitor network. The resistor-capacitor network includes a high resistance connected with the battery, with the base of the control transistor and with a capacitor. The high resistance substantially determines the rate of charging of the capacitor by the battery and so isolates the base of the control transistor from the battery that the voltage of the capacitor effectively determines the voltage at the base of the control transistor and the flow of current through the control transistor and through the switching transistor. The resistor-capacitor network further includes a smaller resistor to control the discharge current from the capacitor through the control transistor and light emitting diode, to ensure bright emission from the light emitting diode with a minimum conduction time of the switching transistor, thereby providing a short duty cycle that is effective to conserve battery power.

Other embodiments of the instant flashing container vessel include different categories of liquid vessels such as beverage drinking containers, liquor shot glasses, and liquid dispensing vessels such as pitchers. Other features and advantages of the invention will be apparent from the drawings and descriptions that follow.

BRIEF DESCRIPTION OF THE DRAWINGS

The present invention will now be described and will be better understood in conjunction with the accompanying drawings, in which.

DETAILED DESCRIPTION OF THE PREFERRED EMBODIMENTS

Figure 1:
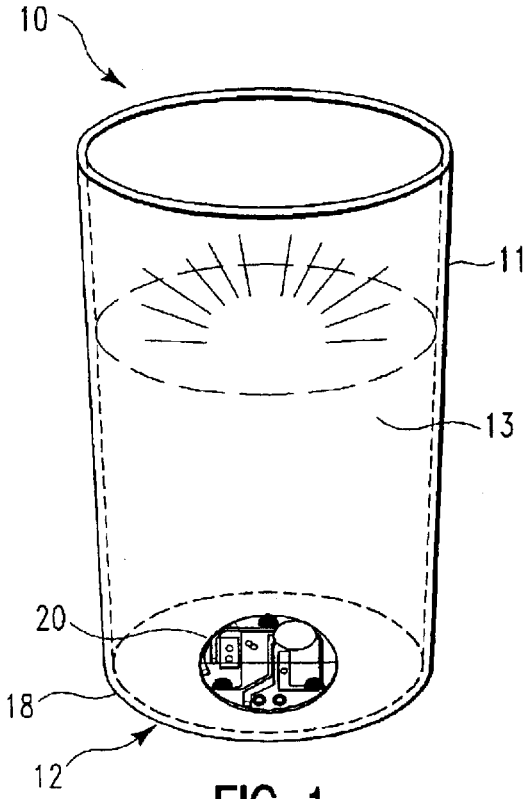
FIG. 1 is a side view perspective of a first embodiment of a flashing liquid drinking glass container constructed in accordance with the present invention, in which the flashing lights amplify the amount of enclosed liquid from a base compartment housing an electronic module LED assembly.

FIGS. 1–4 shows one embodiment of the novelty flashing liquid container vessel 10 of this invention in the form of a drinking glass. FIG. 1 demonstrates a drinking glass 10 and the printed circuit front plate 20 of a blinking LED housed in a separate impervious compartment in the base of the vessel, not shown in FIG. 1 but shown as legend 42 of FIG. 4. That compartment 42 has a front plate 44 adapted to seal the opening 46 in the base of the respective vessels 10 and 40 to receive an electronic component having a plurality of light emitting diodes shown as legend 20 in FIG. 1 and legend 48 of FIG. 4.

Figure 2:
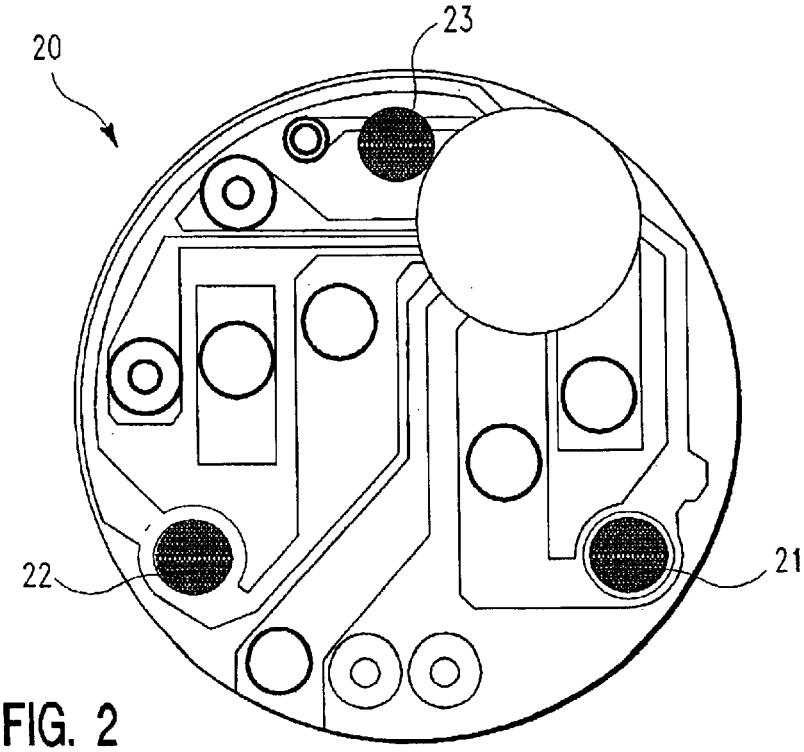
FIG. 2 is a pictorial rendition of the front face plate of a typical LED of the invention.

FIG. 2 shows the front plate 20 of the LED circuitry having a circuit indicia including three alternating blinking lights 21, 22, and 23 in the form of the LED bulbs. The drinking glass 10 of FIG. 1 has smooth translucent circumferential side walls 11 through which the liquid 13 can be viewed through a collage of exciting blinking lights corresponding to the alternating flashing light emanating from the LEDs in the impervious compartment 18 (not actually shown) in the base 12 of FIG. 1. It is apparent that side walls 11 may be provided with any indicia, slogan, trademark or advertising which indicia would be amplified by the blinking lights 21, 22, and 23 of the LED of FIG. 2. It is equally apparent that the container 10 of FIG. 1 can be made of any translucent materials (glass, plastics and synthetic resins, metal alloys etc.) which would render the vessel functional with the blinking or flashing LED arrangement of the present invention. It is to be noted that while the drinking glass is described and shown as transparent, the glass construction may be frosted (not transparent) to further amplify the emitted blinking lights and still remain translucent.

Figure 3:
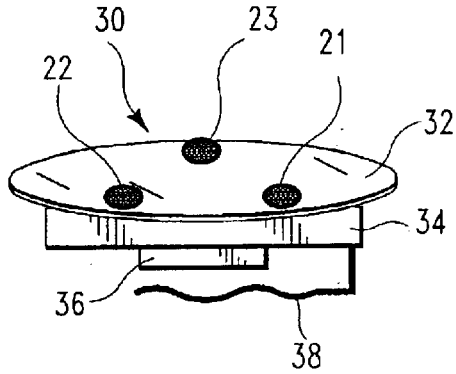
FIG. 3 is a side perspective view of the flashing electronic assembly used in the instant blinking light liquid vessel invention.

FIGS. 2 and 3 are frontal and side perspective drawings respectively of an electronic light generating assembly 20 and 30 of the invention. FIG. 2 shows the front face of the LED assembly 20 as a printed circuit board upon which are mounted a microchip, several transistors and resistors, a ceramic capacitor, and three lights. In a manner well known in the art, the microchip is programmed to provide alternating illumination of the bulbs corresponding to light generating signals corresponding to selected patterns of blinking or flashing lights. For example, the three bulbs shown can be of different or same or unevenly mixed colors and the pattern of blinking can be programmed as desired. The light signals are synchronized in the sense that their frequency and duration bear some relationship to a desired light effect through the liquid; i.e. one may want a longer green illumination and effect through a beer beverage than a transparent soda drink. The microchip programming is set for cyclic flashing of the LEDs in set time periods (e.g. 15 seconds) to save battery energy The microchip programming is set for cyclic flashing of the LEDs in set time periods (e.g. 15 seconds) to save battery energy. Additionally, the printed circuit board may contain a speaker and the microchip programmed in a manner well known in the art to provide audio-generating signals corresponding to animal sounds, music and/or words and to provide light-generating signals which are synchronized with the audio signals.

FIG. 3 shows a side view of the light generating assembly 30 perspectively highlighting the printed circuit board 32, the insulator 34 which may comprise ceramic, flexible plastic or any other electrically insulating materials, the battery 36, and the switch activator 38 comprised of a metallic conductive strip which upon depression enables contact between the battery 36 and the circuit board 32. As shown in the tub glass vessel of FIG. 4, the cylindrically contoured liquid container vessel has two compartments, an upper compartment 41 for containing or housing a liquid and a lower compartment for housing the LEDs or other electronic assemblies such as an electrical circuit including a lamp and battery (not shown). A light transmitting wall in the form of a circumferentially disposed (about the internal circumference of the glass) upper panel 43 physically separates the two compartments and forms an impervious sealable compartment 42 as a continuous vertical extension of the vessel 40.

The compartment 42 is further formed of a lower opening 46 which is sealed by a flat lower panel or piece 44 orthogonally disposed to a center axis of symmetry (not shown) for the demonstrated cylindrically contoured vessel so as to operate with the upper panel 43 to define the impervious compartment 42. The lower panel piece 44 can be any arrangement to seal the lower compartment 42, but must be flexible or operable to effect pressure activation of the switch element 38 of FIG. 3 to cause circuit closure and activation of the three blinking bulbs shown. This is most readily accomplished with a circular flexible plastic piece 44 conforming to the cylindrical opening 46 (FIG. 4) and nested or pressure biased into the lower compartment opening or aperture 46 to seal the lower compartment 42 but allowing finger or pressure flexing to bring the conductive switch 38 of FIG. 3 into contact with the battery element of the LED 30 operating the three bulbs and any audio-generating signals preprogrammed into the microchip face assembly 32.

Figure 4:
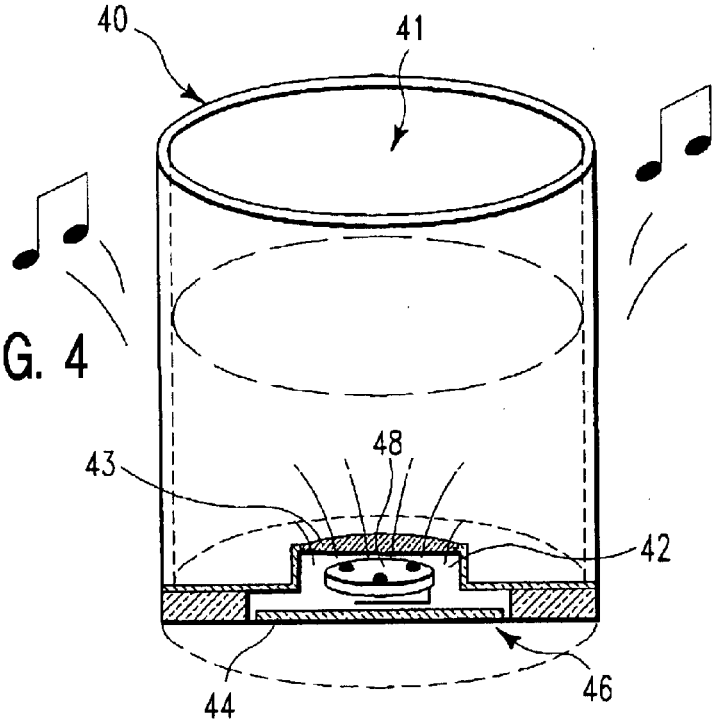
FIG. 4 is a perspective side view of a liquid drinking glass tub container constructed in accordance with the invention highlighting the flashing electronic assembly located in the base of the drinking glass.

Turning to FIG. 4, when liquid is poured into the glass or plastic container shown and the base piece 44 is depressed, the printed circuit is activated and the three LED bulbs begin independently blinking on and off thereby causing a dynamic flashing effect upward through the vessel on through the liquid and highlighting the height (amount) of the liquid surface. If the bulbs are of different colors the flashing is particularly excitingly luminescent, dynamically amplifying both the liquid and cylindrical side walls. If there are trademarks or other markings on the translucent cylindrical wall surfaces, they are highlighted and amplified in a very impressional way. Moreover, if the microchip is preprogrammed for audio, correspondingly and consistent sounds can be synchronized with the flashing lights. For example, three different colored lights (red, green and blue) can be flashed intermittently along with musical bars or notes from the melody of the composition to "White Christmas" to generate a Christmas decor. Additionally, if colored liquids are poured in the vessel, the flashing can cause a chemiluminescent effect through the liquid. The variations on this dynamic flashing vessel concept are endless.

In preferred embodiments, the intant liquid container vessel is a drinking glass fabricated of a transparent plastic such as polyacrylate or polycarbonate polymer. The base portion with its liquid impervious compartment may have a socket to accommodate a probe for re-charging a battery. The base portion of the instant liquid container vessel may also incorporate solar cells such as those employed in small computers. When the drinking vessel is in its upside down, stored state, ambient illumination from the environment acting upon the solar cells serves to charge the battery.

Figure 5:
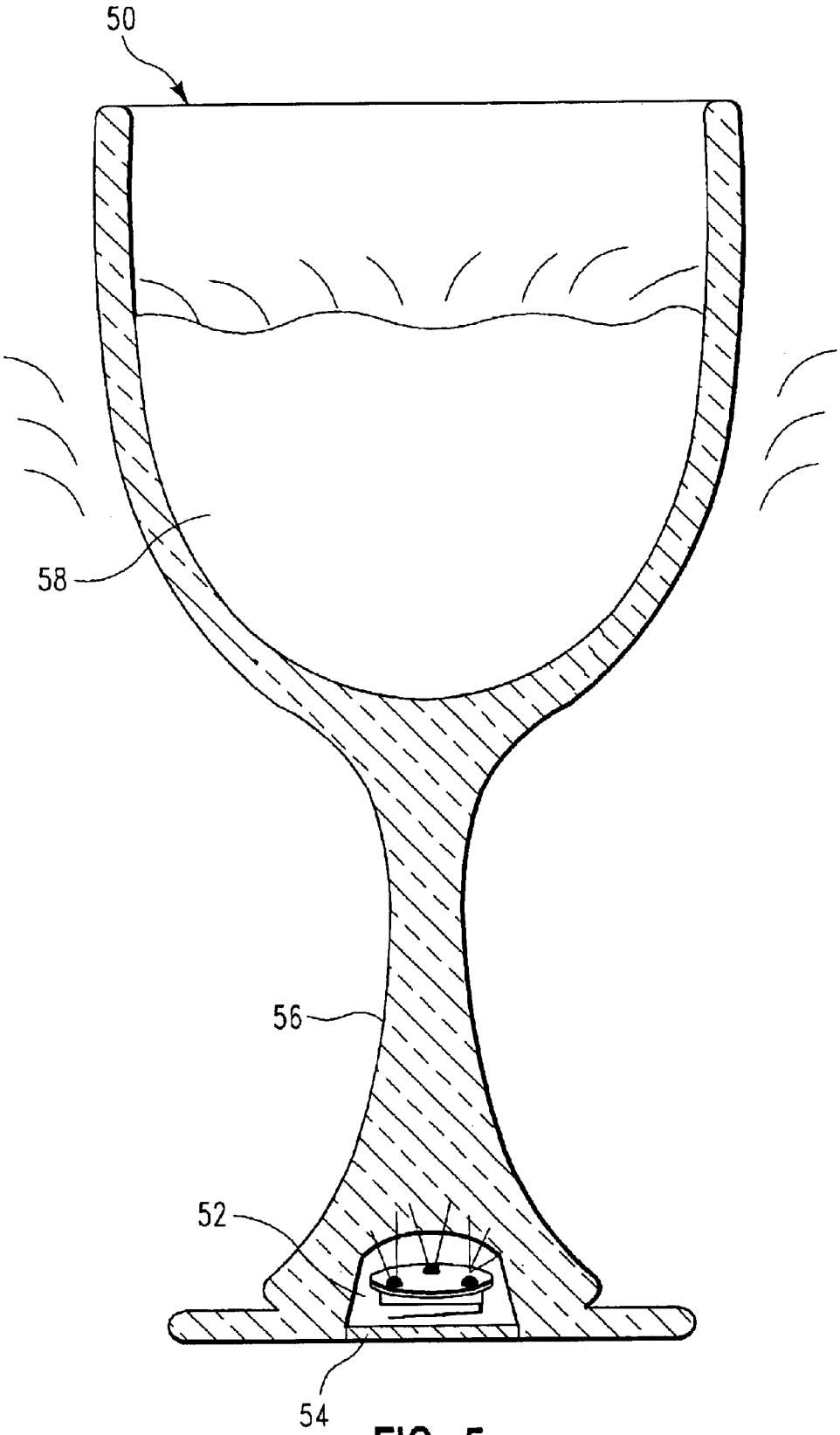
FIG. 5 is a side view of another embodiment of the invention in the form of a flashing wine glass liquid container.

FIG. 5 is another drinking glass embodiment of the present invention in the form of a wine drinking glass 50. At the base of this wine glass is the liquid impervious compartment 52 formed in the same manner and serving the same function as that of the cylindrical drinking glass of FIGS. 1 and 4. In the compartment is the LED shown in FIGS. 2 and 3 as well as the bottom flexible plastic plate, shown as 54 in FIG. 5, which can be depressed to contact the conductor lever 38 (see FIG. 3) to bring the battery into circuit with the printed circuit and actuation (light generating signal) of the multi light bulbs on the LED to cause flashing and blinking of the bulb which light carries up the stem 56 of the wine glass to cause a dynamic luminescence throughout the liquid 58 in the vessel 50.

Figure 6:
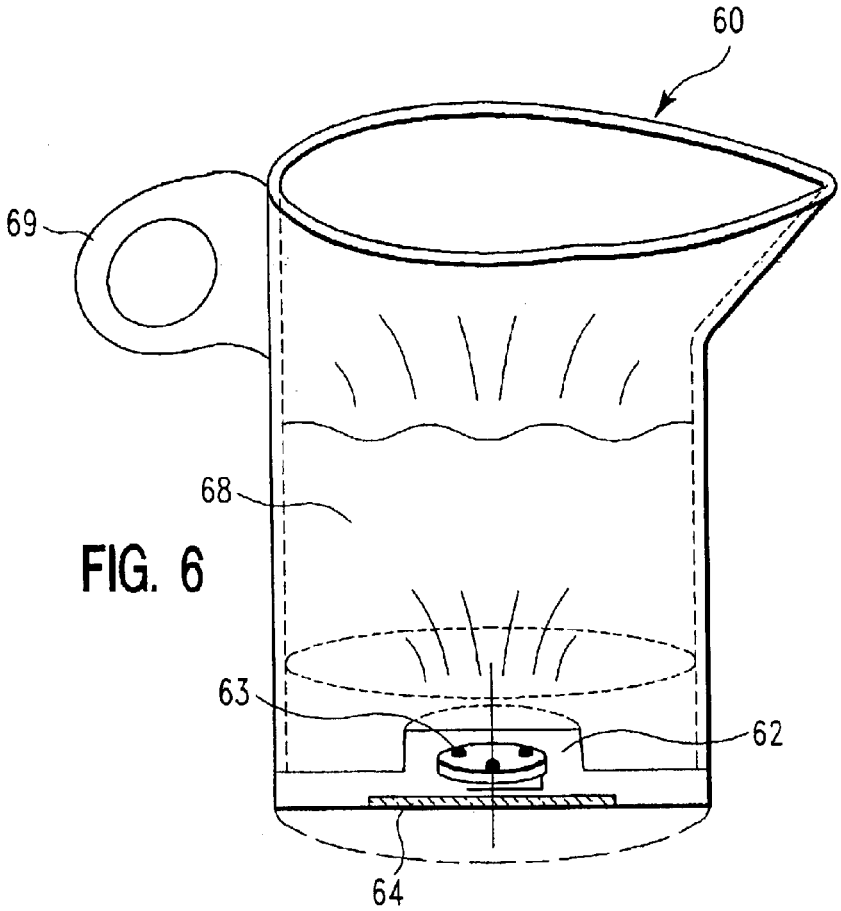
FIG. 6 is a side view of yet another embodiment of the present flashing liquid container vessel in the form of a partially filled glass pitcher for dispensing liquids.

FIG. 6 is a liquid container vessel in the form of a pitcher 60 for dispensing liquids. The pitcher 60 has a separate liquid impervious compartment 62 housing the LED device 63 described and outlined in FIGS. 2 and 3. Again this compartment also has a flexible plastic bottom 64 which when depressed causes blinking lights to flash on through the liquid 68 in the container causing a dynamic luminescence with the captured liquid 68. It is to be noted here the while all the liquid containers demonstrated have the separate compartment for the LED electronic assembly located at the base of the vessel, the flashing electronics can be located in or on the liquid containing vessel to engender the dynamic blinking or flashing light effect of the invention. For example in the dispensing pitcher 60 of FIG. 6, the electronic flashing assembly could be located in the handle 69 to generate a flashing effect throughout the vessel 60 or a chemi-luminescent effect through a colored liquid 68.

Figure 7:
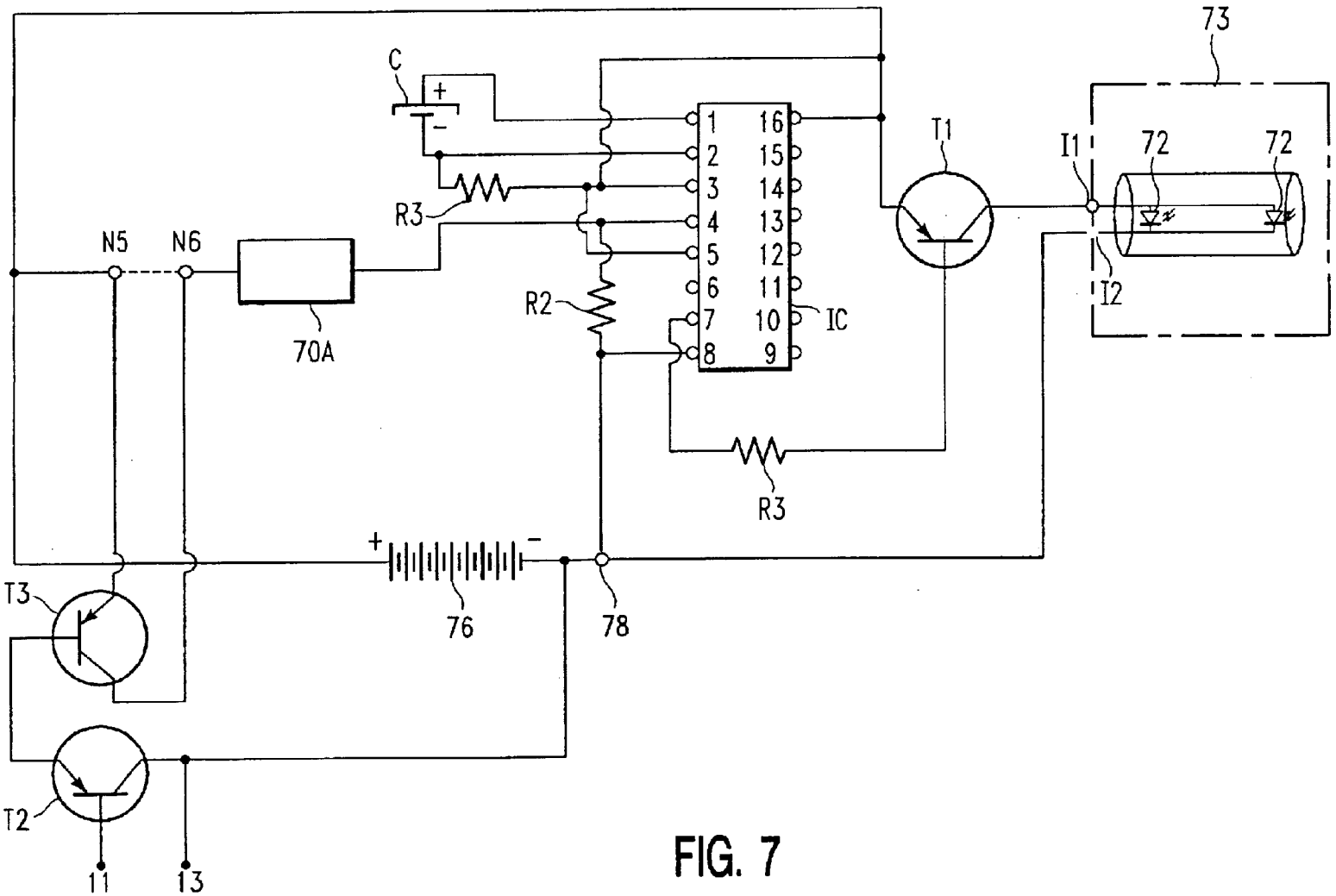
FIG. 7 is a schematic drawing of one arrangement of circuit elements that can be used with the LED in construction of the present invention.

FIG. 7 shows in some detail one version of circuit elements used within the purview of the present invention. The battery 76 is connectable to over motion responsive switch to terminal 4 of integrated circuit IC. Preferred values for the circuit elements are as follows:

IC—INTEGRATED CIRCUIT #RR8503 MC 14528
T1—TRANSISTOR #2N3906
C—CAPACITOR 0.47 uF at 30 V
16—BATTERY 3 V
12—LIGHT SOURCE (LED)
10A—ACTIVATION SWITCH BALL, SWITCH, MERCURY OR OTHERWISE
R1—RESISTOR 1 MEGOHM 1⅛W
R2—RESISTOR 1 MEGOHM 1⅛W
R3—RESISTOR 1 MEGOHM 1⅛W (The integrated circuit and transistor referred to above are both available from Motorola Canada Limited, 3125 Steeles Avenue East, North York, Ontario, Canada).

In operation, with the shoe stationary and horizontal, and the switch 70A open the timing circuit will be quiescent but capacity C will be charged to the value of battery 76 (here 3V). Pin 4 of the integrated circuit will be held at 0 volts which is the voltage arbitrarily designated at node 78. The integrated circuit IC will be in reset condition having the effect that there will be a positive voltage at pin 7, rendering the transistor T1 (i.e. the power switch) non-conducting and maintaining the lights in the illumination circuit 73, off.

When the flexible plate of the liquid vessel container base is finger depressed (see legend 44 of FIG. 4) the switch of the LED makes contact with the battery thereby connecting nodes N5–N6 and causing switch 70A to close, with a connection between battery positive and pin 4, (that is the switch 70A is changing state from "off" to "on"); the (0–1) or 0 V to 3V transition at pin 4 causes the integrated circuit IC to go to "set" condition causing pin 7 of the IC to go to 0 volts. This causes transistor T1 to conduct supplying power to the illumination circuit 23 for the timed or power interval, as determined by IC, C and R1. The 'set' condition of integrated circuit IC connects pin 73 with node 78 and in a time determined by C and R1 the circuit is returned to reset condition, extinguishing LEDs 72 and allowing C to recharge. The circuitry is further designed so that switch 70A must be turned off and on again (with the off to on transition occurring outside the power interval) before the integrated circuit can again be activated to set state. It will be appreciated that the 'ground' shown at node 18 is instrument ground only and is unconnected to anything outside the shoe. The choice of node 78 as 'ground' is somewhat arbitrary but assists on the description of the circuit. The circuit of FIG. 7 would generally require 3 V power but it is preferred to use two 1½V. batteries in series. These batteries are collectively shown and referred to as battery 76.

Figure 8:
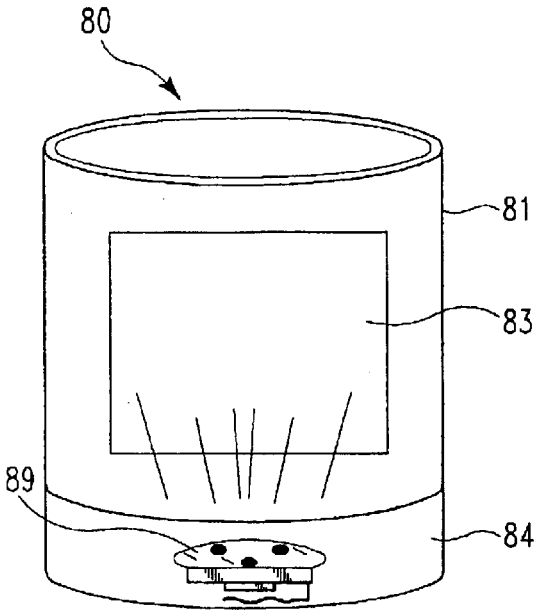
FIGS. 8 to 10 are side views of three alternative embodiments of a flashing light liquid container constructed in accordance with the invention.
Figure 9:
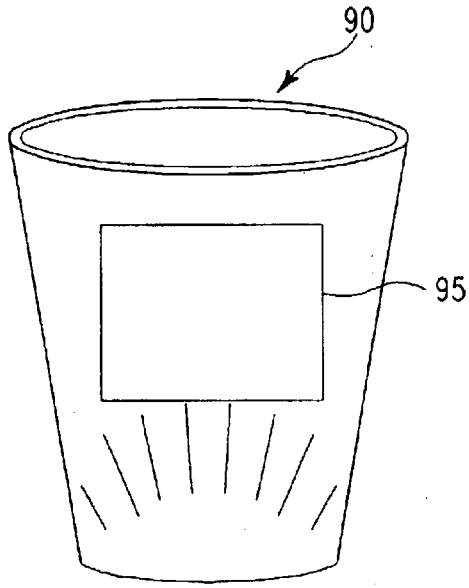
Figure 10:
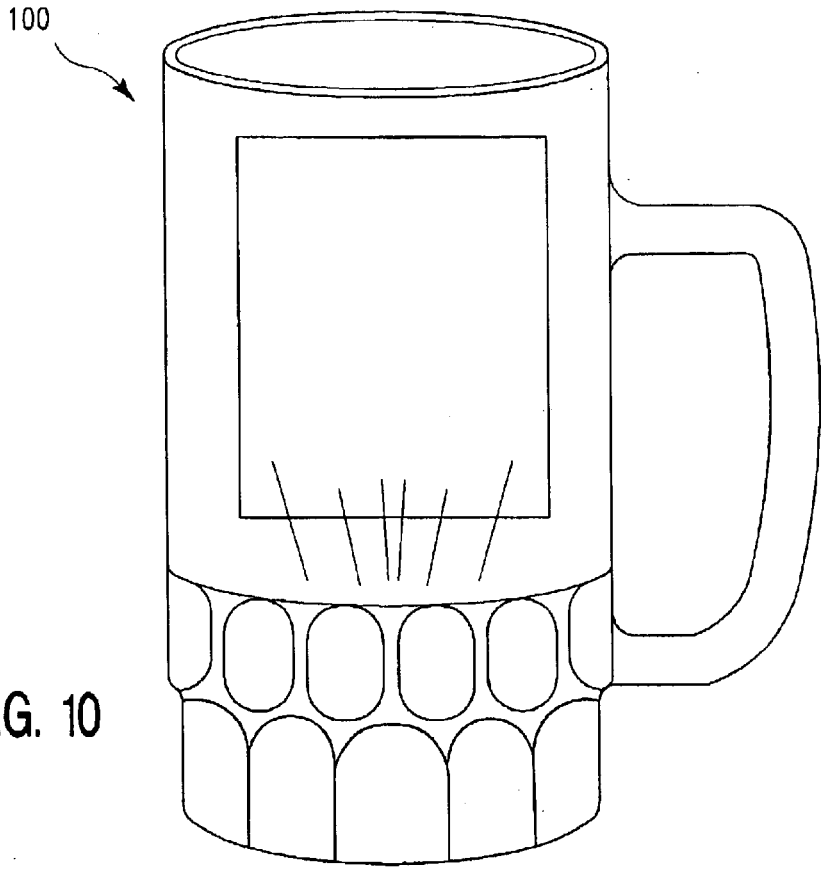

FIGS. 8–10 illustrate various drinking glasses which may employ the instant invention. FIG. 8 demonstrates a typical tub glass 80 with the instant flashing or blinking LED 89 in the separate impervious compartment located in the base 84 with the flashing light emanating up the cylindrical sidewalls 81 to illuminate a design illustrated by the rectangular frame 83. FIG. 9 shows a tapered tub 90 with a rectangular design 95 and a base (not shown) containing the LED of the instant invention. FIG. 10 illustrates a simple beer 100 mug which would operate with a base housed electronic LED assembly in the same manner as all the liquid containing vessels herein.

The present invention thus provides a container for holding liquid having a dynamic blinking or flashing LED to generate luminescence in a container filled with liquid. Such a container can find wide utility as a promotional glass, mug, pitcher, carafe, or similar container in various eating and drinking establishments, such as bars, restaurants, cafes and diners. The container of the present invention is also ideally suited to use in restaurants, gift shops and stands, souvenir shops and stands, and the like in such diverse venues as theme parks, amusement parks, carnivals, circuses, fairs, ballparks and sports arenas of all kinds where beverages are served. The flashing container of the present invention not only heightens awareness through the magnified display of a design or logo during its use, but also provides subsequent enjoyment and amusement as a souvenir item.

While the present invention has been shown and described herein in the form of particular embodiments, it will be apparent to one of ordinary skill in the art that changes and modifications may be made therein without departing from the spirit and scope of the invention as defined in the following claims.

What is claimed is:

1. A flashing liquid container vessel comprising:

(a) a first compartment comprised of translucent sidewalls for holding a liquid;

(b) a second compartment disposed in visual communication with the first and containing an electronic assembly housed within said compartment, said assembly comprised of a battery and a printed circuit board bearing a plurality of light emitting diodes (LEDs) said battery and printed circuit board being electrically insulated from one another;

(c) a light transmitting wall separating said first compartment from said second compartment and forming a liquid impervious barrier to said first compartment; and (d) manual means connected to the vessel for actuating the battery and LEDs to cause alternating flashing of the diode bulbs and dynamic illumination of the vessel, said manual connection means further comprising:

(e) electrical contact means between the battery and the printed circuit so as to cause generation of electricity through the circuit board and flashing of the LEDs; and (f) a flexible panel on the exterior of the second compartment in parallel to the light transmitting separation wall and adjacent the electrical contact means in a manner so as to activate contact between the battery and circuit upon panel depression and cause a timed dynamic blinking or flashing of the LEDs throughout the translucent sidewalls of the vessel.

2. The flashing liquid container vessel of claim 1 wherein the electronic assembly further comprises a microchip and a speaker.

3. The flashing liquid container of claim 1 wherein the microchip is programmed to provide audio-generating signals corresponding to selected animal sounds, music and words.

4. The flashing liquid container of claim 1 wherein the light transmitting wall separating the first compartment from the second compartment forms the bottom of the first compartment thereby situating the second compartment at the base of the container.

5. The liquid container of claim 1 wherein the vessel is a drinking glass comprised of an elongated sidewall portion of cylindrical contour having a center axis of symmetry extending an uppermost lip extremity and a lowermost base extremity, said sidewall portion being bounded by opposed interior and exterior surfaces.

6. A method of generating a flashing mixture of blinking lights through a liquid container vessel comprising:

i) providing the liquid container vessel of claim 1; and ii) depressing the flexible panel at the exterior of the second compartment whereby the battery of the electronic assembly is brought into electrical contact with the circuit board causing blinking of the LEDs and emission of light in a flashing effect through any captured liquid and the translucent sidewalls of the vessel.

* * * * *